US009243304B2

(12) United States Patent
Pieper et al.

(10) Patent No.: US 9,243,304 B2
(45) **Date of Patent: *Jan. 26, 2016**

(54) SOFT MAGNETIC ALLOY AND METHOD FOR PRODUCING A SOFT MAGNETIC ALLOY

(75) Inventors: Witold Pieper, Renningen (DE); Niklas Volbers, Bruchkoebel (DE); Joachim Gerster, Alzenau (DE)

(73) Assignee: VACUUMSCHMELZE GMBH & COMPANY KG, Hanau (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/538,379

(22) Filed: Jun. 29, 2012

(65) Prior Publication Data

US 2013/0000797 A1 Jan. 3, 2013

Related U.S. Application Data

(60) Provisional application No. 61/503,940, filed on Jul. 1, 2011.

(51) Int. Cl.
*C22C 38/10* (2006.01)
*C21D 8/12* (2006.01)
(Continued)

(52) U.S. Cl.
CPC ..... *C21D 8/1222* (2013.01); *C21D 8/1233* (2013.01); *C21D 8/1272* (2013.01);
(Continued)

(58) Field of Classification Search
CPC .. C21D 8/1222; C21D 8/1233; C21D 8/1272; C22C 38/10
USPC ..... 148/100, 120–122, 306–311, 313, 557
See application file for complete search history.

(56) References Cited

U.S. PATENT DOCUMENTS 3,634,072 A * 1/1972 Ackermann et al. ..... 420/581
4,933,026 A * 6/1990 Rawlings et al. ..... 148/311
(Continued)

FOREIGN PATENT DOCUMENTS

DE 69611610 T2 7/2001
DE 69994367 T2 10/2003
(Continued)

OTHER PUBLICATIONS

A.V. Major et al., "High Saturation Ternary Cobalt-Iron Based Alloys", IEEE Transactions on Magnetics, vol. 24, No. 2, Mar. 1988, pp. 1856-1858.
(Continued)

*Primary Examiner* — Jie Yang
(74) *Attorney, Agent, or Firm* — Dickinson Wright PLLC

(57) ABSTRACT

A soft magnetic alloy is provided that consists essentially of 47 weight percent≤Co≤50 weight percent, 1 weight percent≤V≤3 weight percent, 0 weight percent≤Ni≤0.25 weight percent, 0 weight percent≤C≤0.007 weight percent, 0 weight percent≤Mn≤0.1 weight percent, 0 weight percent≤Si≤0.1 weight percent, at least one of niobium and tantalum in amounts of x weight percent of niobium, y weight percent of tantalum, remainder Fe. The alloy includes 0 weight percent≤x<0.15 weight percent, 0 weight percent≤y≤0.3 weight percent and 0.14 weight percent≤(y+2x)≤0.3 weight percent. The soft magnetic alloy has been annealed at a temperature in the range of 730° C. to 880° C. for a time of 1 to 6 hours and comprises a yield strength in the range of 200 MPa to 450 MPa and a coercive field strength of 0.3 A/cm to 1.5 A/cm.

29 Claims, 11 Drawing Sheets

(51) Int. Cl.

| | |
|---|---|
| ***C22C 19/07*** | (2006.01) |
| ***C22C 30/00*** | (2006.01) |
| ***C22C 38/12*** | (2006.01) |
| ***H01F 1/147*** | (2006.01) |

(52) U.S. Cl.

CPC ..... *C22C 19/07* (2013.01); *C22C 30/00* (2013.01); *C22C 38/10* (2013.01); *C22C 38/105* (2013.01); *C22C 38/12* (2013.01); *H01F 1/14708* (2013.01)

(56) References Cited

U.S. PATENT DOCUMENTS

| | | | | |
|---|---|---|---|---|
| 5,501,747 | A | 3/1996 | Masteller et al. | |
| 5,527,399 | A * | 6/1996 | Manning et al. | 148/120 |
| 6,146,474 | A | 11/2000 | Coutu et al. | |
| 7,582,171 | B2 * | 9/2009 | Gerster et al. | 148/315 |
| 2002/0069944 | A1 | 6/2002 | Weihs et al. | |
| 2008/0042505 | A1 * | 2/2008 | Gerster et al. | 310/152 |
| 2013/0000794 | A1 * | 1/2013 | Pieper et al. | 148/522 |

FOREIGN PATENT DOCUMENTS

| | | | |
|---|---|---|---|
| EP | 0824755 | B1 | 1/2001 |
| EP | 1145259 | B1 | 4/2002 |
| JP | 9-228007 | A | 9/1997 |
| WO | WO 00/05733 | A2 | 2/2000 |

OTHER PUBLICATIONS

German Examination Report for App. No. 10 2012 105 606.5 dated Nov. 3, 2014.

* cited by examiner

SOFT MAGNETIC ALLOY AND METHOD FOR PRODUCING A SOFT MAGNETIC ALLOY

This application claims benefit of the filing date of U.S. Provisional Application Ser. No. 61/503,940, filed Jul. 1, 2011, the entire contents of which are incorporated herein by reference for all purposes.

BACKGROUND

1. Field

Disclosed herein are soft magnetic alloy compositions containing iron, cobalt, vanadium, and at least one of niobium and tantalum with low amounts, if any, of carbon. Also disclosed herein are methods for manufacturing such soft magnetic alloys. Also disclosed are annealed alloys of the composition noted above and having high yield strengths and magnetic properties suitable for rotating electrical devices, wherein the yield strength can be adjusted by varying the annealing temperature.

2. Description of Related Art

A ferromagnetic material that can be magnetized, but tends not to remain magnetized is described as magnetically soft. When a magnetically soft material is magnetised in a magnetic field and then removed from the magnetic field, it loses most of the magnetism exhibited while in the field. A magnetically soft material preferably displays a low hysteresis loss, high magnetic permeability and a high magnetic saturation induction. Magnetically soft materials are used in various static and rotating electrical devices, such as motors, generators, alternators, transformers and magnetic bearings.

U.S. Pat. No. 5,501,747 discloses a high strength, soft magnet iron-cobalt-vanadium based alloy which further comprises 0.15 weight percent to 0.5 weight percent niobium and 0.003 weight percent to 0.02 weight percent carbon. This alloy is disclosed as having a combination of yield strength, magnetic properties and electrical properties which enables it to be used for the rotating part, such as a rotor, of a rotating electrical machine. When the alloy is annealed at a temperature of not more than about 740° C. for not more than about 4 hours, it has a room temperature yield strength of at least 620 MPa.

However, further soft magnetic alloys having a combination of a high yield strength and suitable magnetic properties for applications such as rotating electrical devices are desirable.

SUMMARY

A soft magnetic alloy is provided that consists essentially of 47 weight percent≤Co≤50 weight percent, 1 weight percent≤V≤3 weight percent, 0 weight percent≤Ni≤0.25 weight percent, 0 weight percent≤C≤0.007 weight percent, 0 weight percent≤Mn≤0.1 weight percent, 0 weight percent≤Si≤0.1 weight percent, at least one of niobium and tantalum in amounts of x weight percent of niobium, y weight percent of tantalum, remainder Fe. The niobium and tantalum contents are within the ranges of 0 weight percent≤x<0.15 weight percent, 0 weight percent≤y≤0.3 weight percent and are such that 0.14 weight percent≤(y+2x)≤0.3 weight percent. The soft magnetic alloy has been annealed at a temperature in the range of 730° C. to 880° C. for a time of 1 to 6 hours and has a yield strength in the range of 200 MPa to 450 MPa and a coercive field strength of 0.3 to 1.5 A/cm.

The alloy is based on a 49% Co-2% V—Fe-type alloy which further includes niobium and/or tantalum in amounts within the range of 0 weight percent≤x<0.15 weight percent and 0 weight percent≤y≤0.3 weight percent, respectively. The total amount of niobium and tantalum is described by the parameter (y+2x), i.e. the amount of tantalum in weight percent, y, in addition to twice the amount of niobium in weight percent, 2x, and this parameter desirably lies within a range of 0.14 weight percent to 0.3 weight percent. The alloy further includes a maximum carbon content of 0.007 weight percent and optionally Ni up to 0.2 weight percent.

The elements manganese and silicon are also optional and may be added in order to reduce the oxygen content of the alloy. Oxygen is not intentionally added to the alloy, but may be present as an impurity in amounts up to around 0.009 weight percent. Further impurity elements such as one or more of the elements Cr, Cu, Mo, Al, S, Ti, Ce, Zr, B, N, Mg, Ca or P may be present in a total amount of not more than 0.5 weight percent.

The soft magnetic alloy is also free of Boron. In this context, free of Boron includes a boron content of less than 0.0007 weight percent as well as a zero Boron content.

For alloys of the 49% Co-2% V—Fe-type, the annealing temperature is generally observed to have opposing effects on the mechanical properties and the magnetic properties. In particular, the yield strength is observed to increase for decreasing annealing temperatures, whilst the magnetic properties are observed to improve by annealing at higher temperatures.

A combination of a niobium content, x, and/or tantalum content, y, with the relationship y+2x within the range of 0.14 to 0.3 weight percent and a carbon content of less than 0.007 weight percent, or less than 0.005 weight percent or less than 0.003 weight percent, provides a soft magnetic alloy with a yield strength that can be adjusted as desired over a range of 200 MPa to 450 MPa by appropriate selection of the annealing conditions. At the same time, soft magnetic properties suitable for soft magnetic parts, such as a rotor or a stator, of a rotating electrical machine can be obtained.

A coercive field strength of 1.5 A/cm may be achieved for an alloy that was annealed at an annealing temperature of 730° C. whilst a coercive field strength of 0.3 A/cm may be achieved for an alloy that was annealed at 880° C.

One explanation for this behaviour is that by reducing the carbon content, the formation of Laves phases (Co/Fe, Nb) is favoured while the formation of carbides is reduced, thus enabling a suitably high yield strength to be obtained without resulting in a worsening of the magnetic properties to such a degree that they are no longer suitable for use in electric machines.

In a rotating electrical machine, the rotor typically requires a higher yield strength than the stator as the rotor rotates during use and is subjected to centrifugal forces. It may be useful if the yield strength of the material of the rotor is sufficiently high that the rotor remains below its elastic limit despite the centrifugal forces. In contrast, the stator is static and not subjected to centrifugal force so that the stator may have a lower yield strength than that of the rotor.

Usefully, the yield strength and the magnetic properties of the soft magnetic alloy according to the invention can be adjusted by annealing the parts for the rotor and for the stator at different annealing temperatures so that the same composition can be used for both the rotor and the stator of an electrical machine.

In a further embodiment, the total of the niobium and tantalum content is limited to 0.25 so that 0.14 weight percent≤(y+2x)≤0.25 weight percent.

If tantalum is omitted so that y=0, the niobium content may be 0.07 weight percent≤x<0.15 weight percent.

If niobium is omitted, so that x=0, the tantalum content may be 0.14 weight percent≤y≤0.3 weight percent.

In a further embodiment, the upper limit of the nickel content is reduced to 0.2 weight percent so that 0 weight percent≤Ni≤0.20 weight percent.

The maximum amount of carbon may be reduced to 0 weight percent≤C≤0.005 weight percent or to 0 weight percent≤C<0.003 weight percent. Reducing the carbon content may be useful in improving the magnetic properties.

As discussed above, manganese and silicon are optional. In some embodiments the soft magnetic alloy includes manganese and/or silicon within a range of 0 weight percent<Mn≤0.07 weight percent and/or 0 weight percent<Si≤0.07 weight percent. In further embodiments, 0.07 weight percent<Mn≤0.1 weight percent and/or 0.07 weight percent<Si≤0.1 weight percent.

In an embodiment, the soft magnetic alloy comprises a yield strength (0.2% strain), $Rp_{0.2}$, of between 200 MPa and 450 MPa in an annealed state. The yield strength can be adjusted as desired by adjusting the annealing conditions, in particular, by selecting a suitable annealing temperature.

The soft magnetic alloys having a composition within the ranges given above display a linear dependence of the yield strength with annealing temperature. This feature is not displayed by commercially available alloys with about 0.05 wt. % Nb and 100 ppm C such as HIPERCO 50. In the following, alloys with about 0.05 wt. % Nb and 100 ppm C are referred to as reference alloys.

In an embodiment, the soft magnetic alloy comprises a yield strength (0.2% strain) that is a linear function of annealing temperature over an annealing temperature range of 740° C. to 865° C. or 730° C. to 900° C.

In an embodiment, in an annealed state, the soft magnetic alloy comprises a yield strength (0.2% strain) that lies within ±10% of a linear function of yield strength (0.2% strain) against annealing temperature obtained for the alloy.

In an annealed state, the soft magnetic alloy may comprise a resistivity of at least 0.4 μΩm and/or an induction B (8 A/m) of at least 2.12 T.

As discussed above, the soft magnetic alloy comprises a combination of mechanical strength and soft magnetic properties that are suitable for the soft magnetic parts of a rotating electrical machine. In an embodiment, the soft magnetic alloy is annealed such that it has, in the annealed state, an induction B (8 A/m) of at least 2.12 T and a yield strength of at least 370 MPa. This combination of properties is suitable for a rotor of an electric machine.

In a particular embodiment, after annealing at a temperature in the range of 720° C. to 900° C., the soft magnetic alloy comprises a yield strength in the range of 200 MPa and 450 MPa, and a power loss density at 2 T and 400 Hz of less than 90 W/kg. In further embodiments, for an annealing temperature of 720° C., the power loss density at 2 T and 400 Hz is less than 90 W/kg and for an annealing temperature of 900° C. is less than 65 W/kg.

A stator for an electric motor and a rotor for an electric motor comprising a soft magnetic alloy according to one of the previously described embodiments is also provided. An electric motor comprising a stator and a rotor each comprising a soft magnetic alloy having a composition according to one of the previously described embodiments is also provided. The rotor and the stator may have the same composition, but differing mechanical properties and magnetic properties. This may be provided by annealing the rotor or parts forming the rotor under different annealing conditions compared to the stator or parts forming the stator.

The rotor and/or the stator may comprise a plurality of plates or layers that are stacked together to form a laminate.

The electric machine may be a motor, a generator, an alternator, or a transformer.

A method for manufacturing a soft magnetic alloy is provided which comprises providing a melt consisting essentially of 47 weight percent≤Co≤50 weight percent, 1 weight percent≤V≤3 weight percent, 0 weight percent≤Ni≤0.25 weight percent, 0 weight percent≤C≤0.007 weight percent, 0 weight percent≤Mn≤0.1 weight percent, 0 weight percent≤Si≤0.1 weight percent, at least one of niobium and tantalum in amounts of x weight percent of niobium or y weight percent of tantalum, remainder Fe, wherein 0 weight percent≤x<0.15 weight percent, 0 weight percent≤y≤0.3 weight percent and 0.14 weight percent≤(y+2x)≤0.3 weight percent. This melt is cooled and solidified to form a blank. The blank is hot rolled, quenched and then cold rolled. Subsequently, at least a portion of the blank is annealed at a temperature in the range of 730° C. to 880° C. and a yield strength in the range of 200 MPa to 450 MPa and a coercive field strength of 0.3 A/cm to 1.5 A/cm is produced.

After cold rolling, the blank may have the form of a plate or ribbon. Pieces of the blank may be removed by stamping or cutting, for example, and the piece or pieces annealed at a suitably selected temperature to obtain the desired mechanical and magnetic properties.

In further embodiments, at least a portion of the blank is annealed at a temperature in the range of 740° C. to 865° C. or in the range of 730° C. to 790° C. or in the range of 800° C. to 880° C. The higher temperature range of 800° C. to 880° C. may be used when fabricating a stator from the soft magnetic alloy and the lower temperature range of 730° C. to 790° C. may be used when fabricating a rotor from the soft magnetic alloy.

In a further embodiment, a thickness reduction in the blank of about 90% is produced by the hot rolling of the blank. This thickness reduction may be selected so as to select the desired thickness reduction in the subsequent cold rolling step and the amount of deformation introduced into the soft magnetic alloy.

The blank may be hot rolled at a temperature in the range of 1100° C. to 1300° C. After hot rolling, the blank may be naturally cooled. After hot rolling, the strip is quenched from a temperature above 730° C. to room temperature or to below room temperature. This may be carried out whilst the strip is cooling from the hot rolling temperature. Alternatively, the strip may be cooled to room temperature and afterwards reheated to a temperature above 730° C. and quenched to room temperature or to below room temperature.

After hot rolling and before cold rolling, the blank may be cleaned, for example pickled and/or mechanically worked, for example by sand blasting, to clean the surface. This improves the surface finish of the blank after cold rolling and may also aid in improving the magnetic properties of the alloy after annealing.

In an embodiment, a thickness reduction in the blank of 90% is produced by the cold rolling of the blank. After cold rolling, the thickness of the blank may lie in the range of 0.3 mm to 0.4 mm. This thickness is suitable for producing laminated articles such as laminated rotors and laminated stators for electric machines.

A method for manufacturing a semi-finished part is also provided that comprises performing the method according to one of the previously described embodiments and separating a portion of the blank to produce a semi-finished part.

A laminated article may be formed by assembling a plurality of semi-finished parts comprising a soft magnetic alloy according to one of the embodiments described above.

A rotor for an electric motor may be provided by annealing the soft magnetic alloy or the laminated article according to one of the previously described embodiments at a temperature of 730 to 790° C.

A stator for an electric motor may be provided by annealing the soft magnetic alloy or the laminated article according to one of the previously described embodiments at a temperature of 800° C. to 880° C.

BRIEF DESCRIPTION OF DRAWINGS

Specific examples and embodiments will now be described with reference to the accompanying drawings.

DETAILED DESCRIPTION OF SPECIFIC EMBODIMENTS

Figure 1:
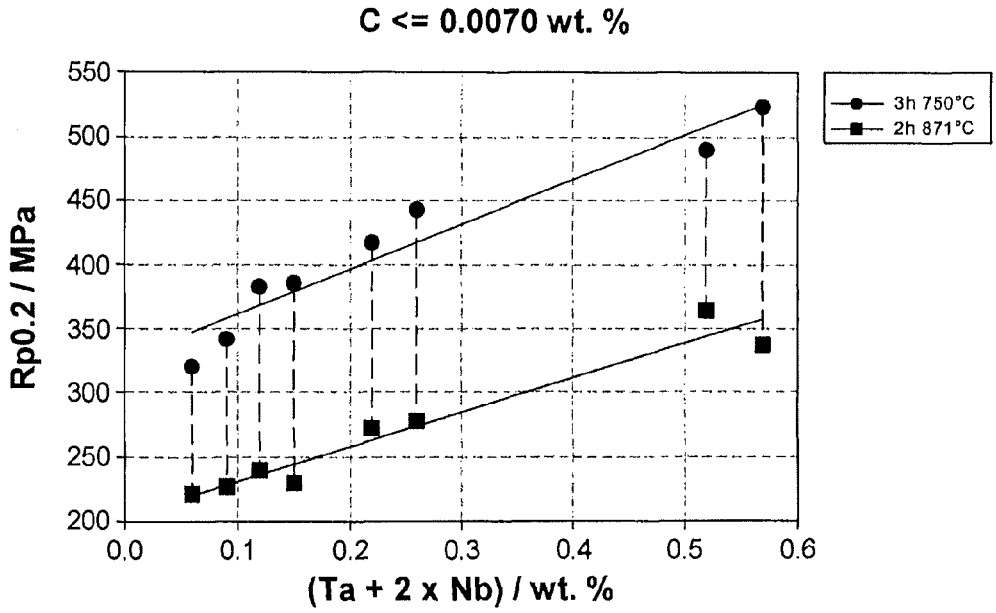
FIG. 1 illustrates a graph of yield strength $Rp_{0.2}$ vs. (Ta+2×Nb) for a low carbon content.

The various embodiments disclosed herein can be more clearly understood with reference to the specific examples and the information contained in the Table disclosed herein, wherein:

Table 1 illustrates a summary of compositions, mechanical properties and magnetic properties of alloys and comparison alloys.

A soft magnetic alloy is provided that consists essentially of 47 weight percent≤Co≤50 weight percent, 1 weight percent≤V≤3 weight percent, 0 weight percent≤Ni≤0.25 weight percent, 0 weight percent≤C≤0.007 weight percent, 0 weight percent≤Mn≤0.1 weight percent, 0 weight percent≤Si≤0.1 weight percent, at least one of niobium and tantalum in amounts of x weight percent of niobium, y weight percent of tantalum, remainder Fe. The alloy includes 0 weight percent≤x<0.15 weight percent, 0 weight percent≤y≤0.3 weight percent and 0.14 weight percent≤(y+2x)≤0.3 weight percent. The soft magnetic alloy has been annealed at a temperature in the range of 730° C. to 880° C. for a time of 1 to 6 hours and comprises a yield strength in the range of 200 MPa to 450 MPa and a coercive field strength of 0.3 A/cm to 1.5 A/cm.

The soft magnetic alloy may be produced by providing a melt consisting essentially of 47 weight percent≤Co≤50 weight percent, 1 weight percent≤V≤3 weight percent, 0 weight percent≤Ni≤0.25 weight percent, 0 weight percent≤C≤0.007 weight percent, 0 weight percent≤Mn≤0.1 weight percent, 0 weight percent≤Si≤0.1 weight percent, at least one of niobium and tantalum in amounts of x weight percent of niobium or y weight percent of tantalum, remainder Fe, wherein 0 weight percent≤x<0.15 weight percent, 0 weight percent≤y≤0.3 weight percent and 0.14 weight percent≤(y+2x)≤0.3 weight percent. The melt is then cooled and solidified to form a blank. The blank is then hot rolled, for example at 1200° C., cooled or reheated to 730° C. and then quenched to room temperature. The blank is then cold rolled at room temperature to a final thickness of 0.35 mm, for example. Subsequently at least a portion of the blank is annealed at a temperature in the range of 730° C. to 880° C. to form a semi-finished product comprising a yield strength in the range of 200 MPa to 450 MPa and a coercive field strength of 0.3 A/cm to 1.5 A/cm.

The annealing temperature is chosen so that it lies between the recrystallization temperature of around 720° C. and the phase transformation from the alpha, α, phase to the gamma, γ, phase at around 885° C. The annealing temperature is selected within this range so that the semi-finished product has the desired mechanical properties, in particular, the desired yield strength (0.2% strain), $Rp_{0.2}$, in combination with the desired magnetic properties, in particular, power loss density.

It is observed that a combination of a niobium and/or tantalum content described by the parameter (y+2x), whereby y is the tantalum content in weight percent and x is the niobium content in weight percent, within the range of 0.14 to 0.3 weight percent and a carbon content of less than 0.007 weight percent, or less than 0.005 weight percent, or less than 0.003 weight percent, provides a soft magnetic alloy with a yield strength that can be adjusted as desired over a range of 200 MPa to 450° C. by appropriate selection of the annealing temperature. At the same time, soft magnetic properties suitable for soft magnetic parts of rotating electrical machines can be obtained.

Usefully, the yield strength and the magnetic properties can be adjusted so that the same composition can be used for both the rotor and the stator of an electrical machine by annealing the parts for the rotor and for the stator at different annealing temperatures. For example, parts for a rotor may be annealed at 750° C. and have a higher yield strength than parts for the stator which are annealed at 870° C. In this example, the stator has significantly better magnetic properties than the rotor.

The composition, annealing conditions and measured mechanical and magnetic properties of sample alloys according to the invention and of comparison alloys are summarized in Table 1.

In a first set of embodiments, the effect of composition on the mechanical and magnetic properties is investigated. For each sample alloy, an anneal of 750° C. for 3 hours and an anneal at 871° C. for 2 hours is illustrated and connected with one another with a dotted line.

In the figures, the relationship of niobium and tantalum (y+2x) is represented as Ta+2×Nb.

FIG. 1 illustrates a graph of yield strength $Rp_{0.2}$ vs. (Ta+2×Nb) for alloys with a low carbon content, in particular a carbon content of less than or equal to 0.007 weight percent and differing values of (y+2x).

The lowest achieved yield strength and the highest achieved yield strength for each sample alloy increase a similar amount with increasing Nb and Ta content as represented by the quantity (y+2x). The range over which the yield strength may be adjusted remains relatively large. This is useful as a single composition can comprise a larger range of yield strengths by selecting the annealing conditions.

Figure 2:
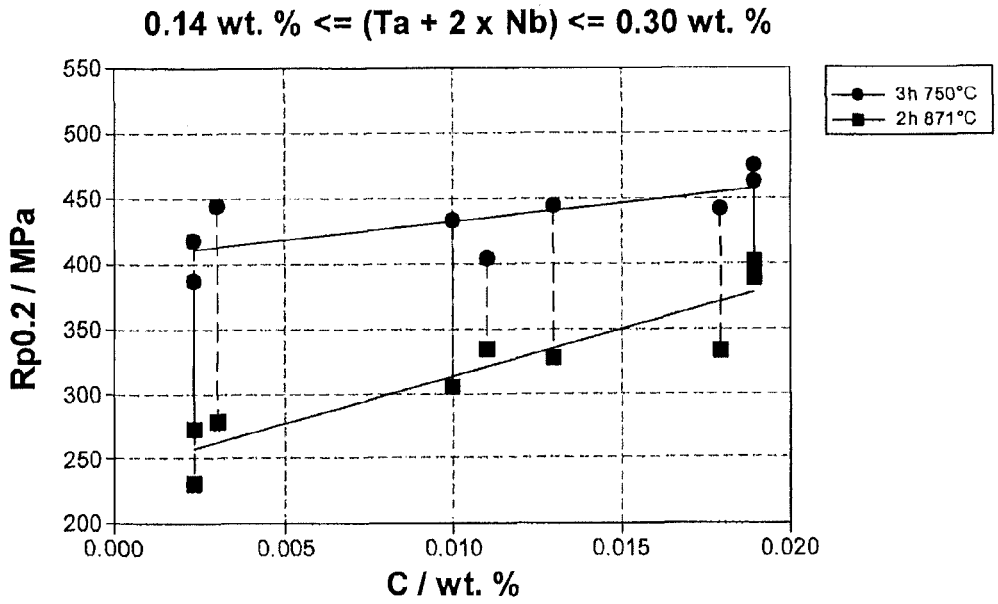
FIG. 2 illustrates a graph of yield strength $Rp_{0.2}$ vs. carbon for a Nb- and Ta-content according to the invention.

FIG. 2 illustrates a graph of yield strength $Rp_{0.2}$ vs. carbon content for a single Nb- and Ta-content as represented by the quantity (y+2x) as described herein. The yield strength increases with increasing carbon content. However, the range over which the yield strength can be adjusted by selecting the annealing temperature is reduced for increased carbon contents. The carbon content should be kept small in order to be able to adjust the yield strength over a large range.

Figure 3:
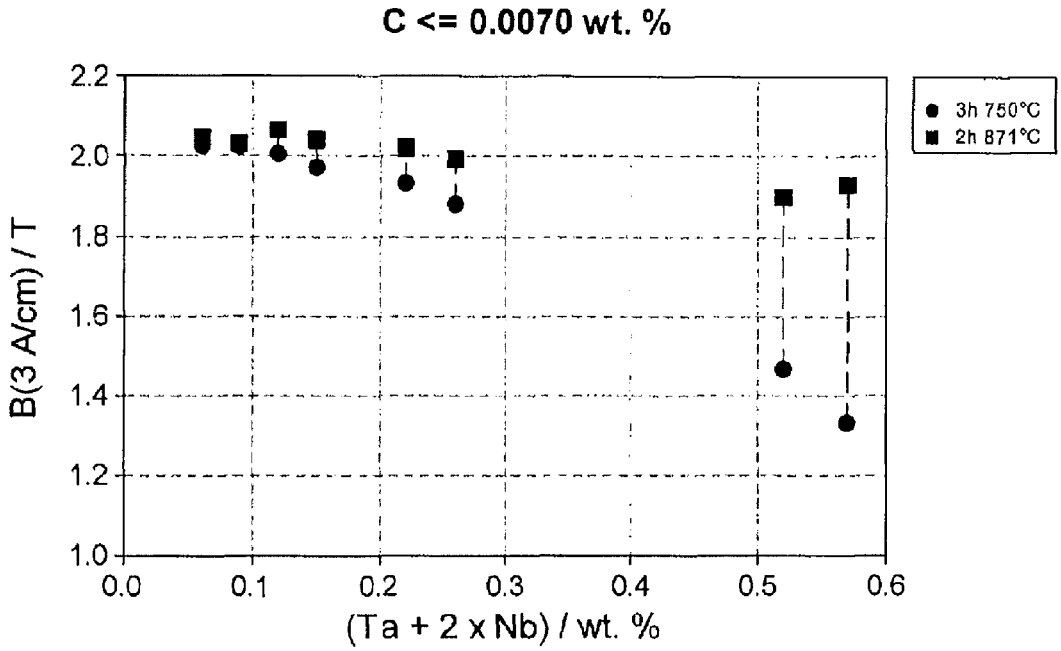
FIG. 3 illustrates a graph of magnetic induction B (3 A/cm) vs. (Ta+2×Nb) for a low carbon content.

FIG. 3 illustrates a graph of magnetic induction B (3 A/cm) vs. (Ta+2×Nb) for sample alloys with a carbon content of less than or equal to 0.007 weight percent.

The magnetic induction B (3 A/cm) decreases with increasing Nb and Ta content, particularly for alloys having (y+2x) greater than 0.5 wt. %. However, for the alloys having a Ta and Nb content (y+2x) within the range of 0.14 to 0.3 weight percent, the decrease is moderate after an annealing treatment at 871° C. for 2 hours.

Figure 4:
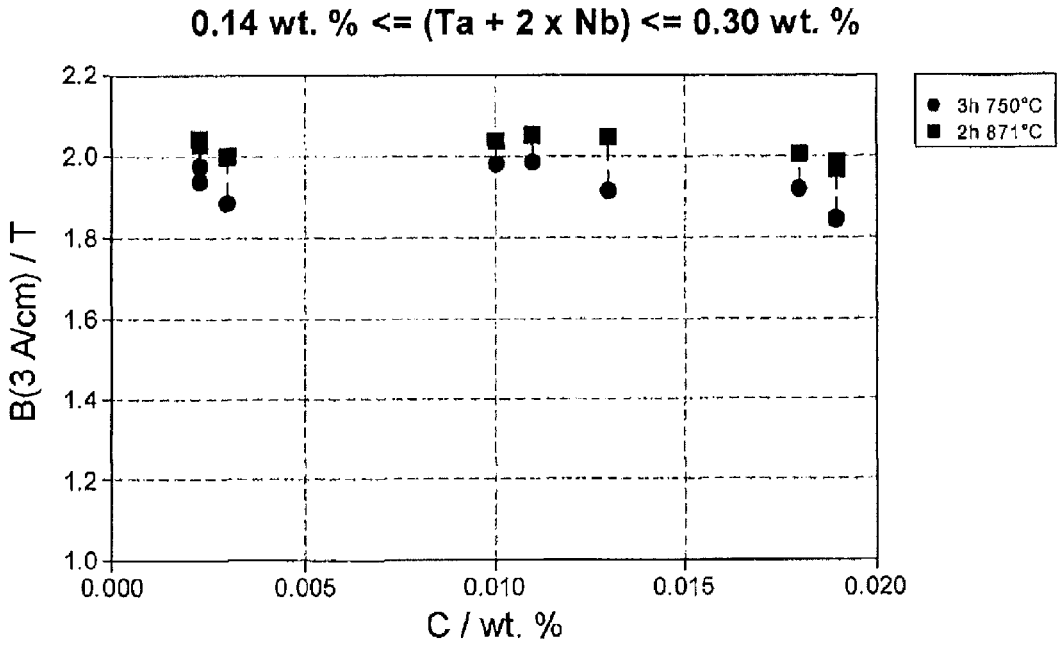
FIG. 4 illustrates a graph of magnetic induction B (3 A/cm) vs. carbon content for a Nb- and Ta-content according to the invention.

FIG. 4 illustrates a graph of magnetic induction B (3 A/cm) vs. carbon content for a Nb- and Ta-content (y+2x) over the range for embodiments described herein. No significant trend is observed, indicating that this magnetic property remains stable and predictable over this range of Nb- and Ta-content.

Figure 5:
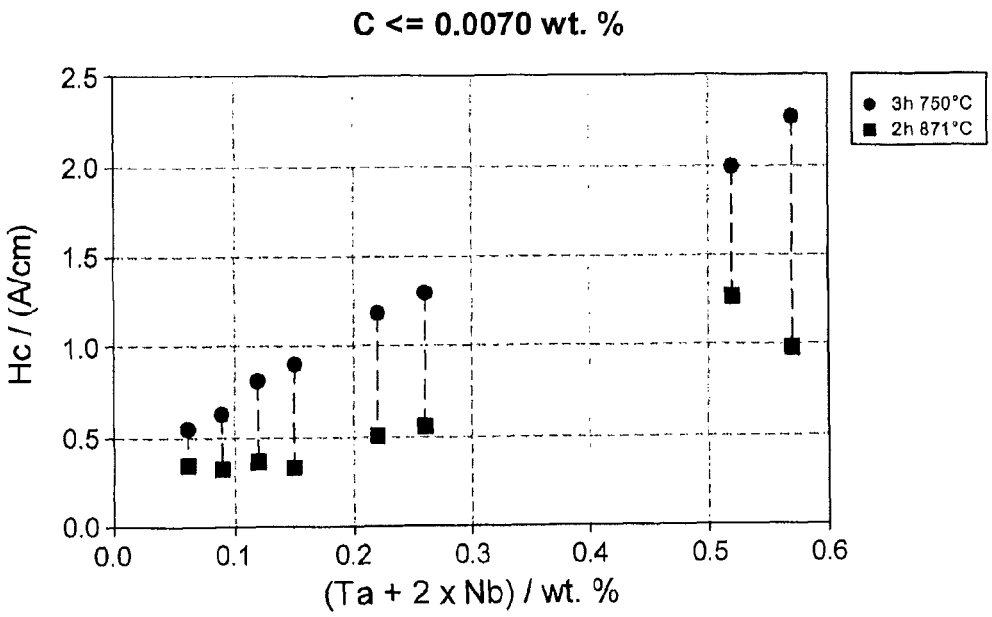
FIG. 5 illustrates a graph of coercive field strength Hc vs. (Ta+2×Nb) for a low carbon content.

FIG. 5 illustrates a graph of coercive field strength Hc vs. (Ta+2×Nb) for a carbon content of less than or equal to 0.007 weight percent. The difference in Hc is smaller for smaller (Ta+2Nb) contents. The worsening effect on Hc of the decreased annealing temperature is lower for lower Nb and Ta contents.

Figure 6:
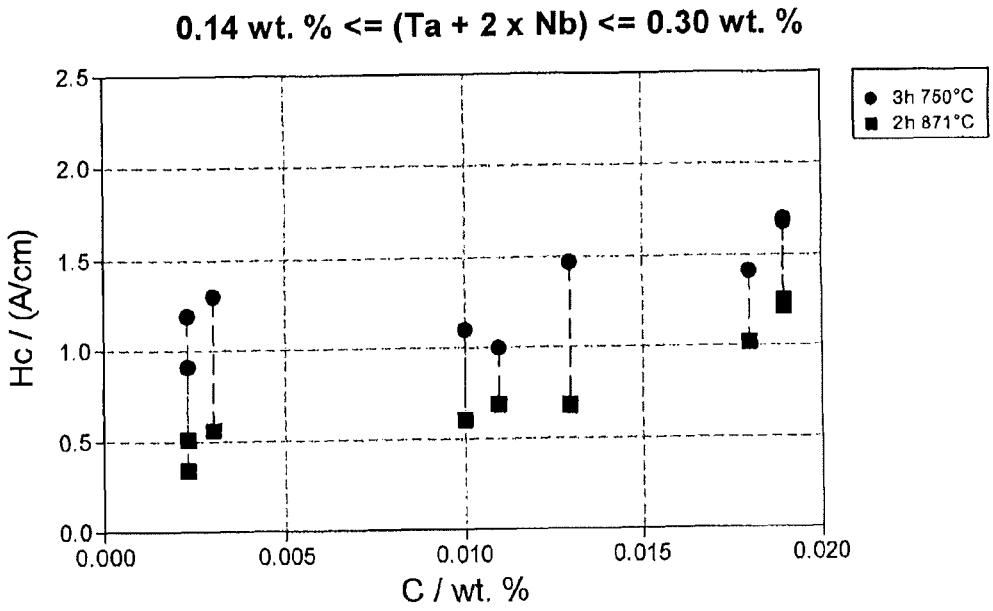
FIG. 6 illustrates a graph of coercive field strength Hc vs. carbon content for a Nb- and Ta-content according to the invention.

FIG. 6 illustrates a graph of coercive field strength Hc vs. carbon content for a Nb- and Ta-content (y+2x) of less than 0.3 wt. %.

Figure 7:
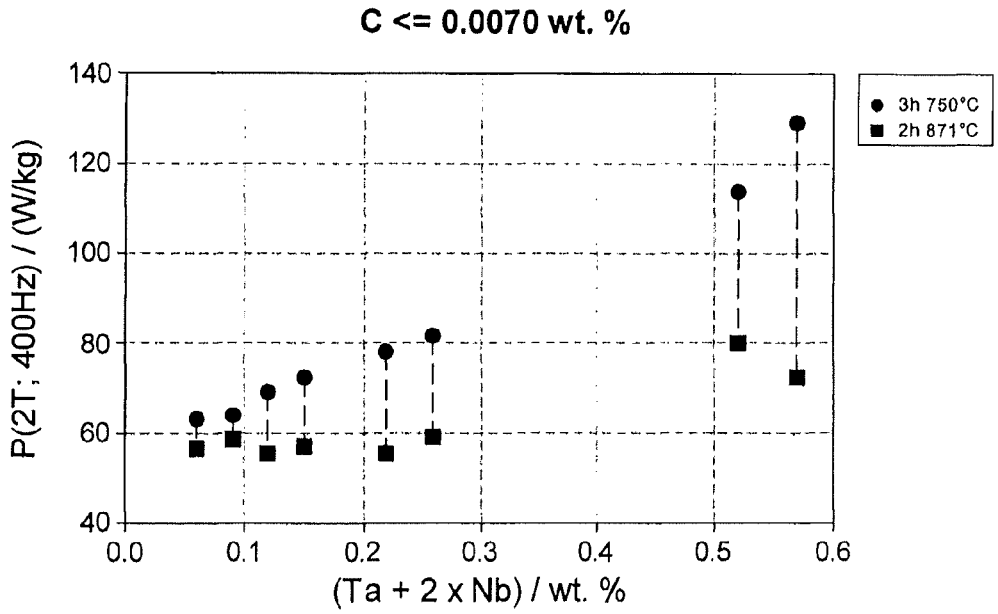
FIG. 7 illustrates a graph of power loss density P (2 T; 400 Hz) vs. (Ta+2×Nb) for a low carbon content.

FIG. 7 illustrates a graph of power loss density P (2 T; 400 Hz) vs. (Ta+2×Nb) for low carbon contents of less than or equal to 0.007 weight percent. The losses after an annealing treatment of 871° C. for 2 hours remain low for Ta and Nb contents (y+2x) of less than 0.3.

Figure 8:
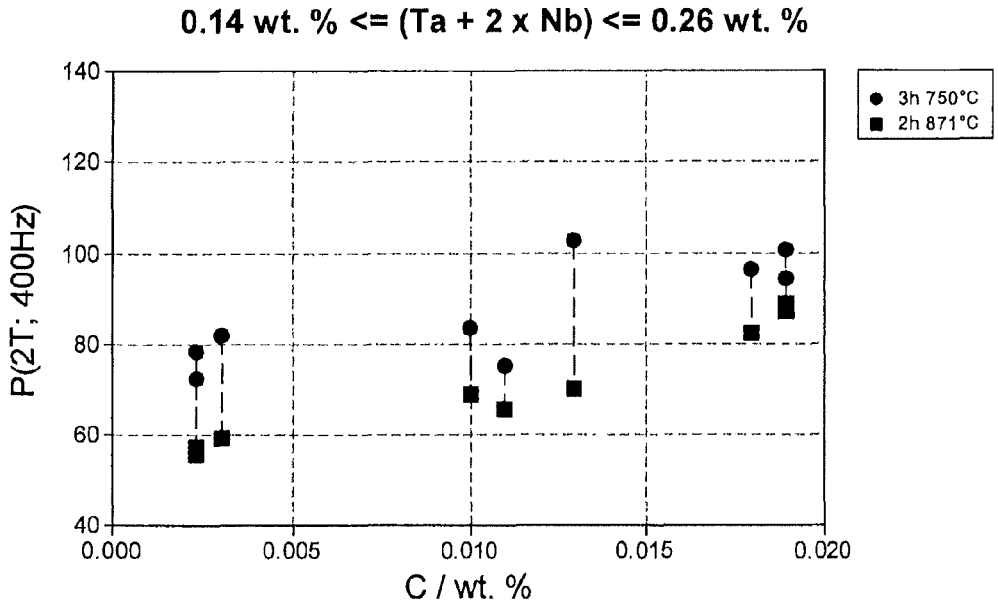
FIG. 8 illustrates a graph of power loss density P (2 T; 400 Hz) vs. Carbon content for alloys having a Nb- and Ta-content according to the invention.

FIG. 8 illustrates a graph of power loss density P (2 T; 400 Hz) vs. Carbon content for alloys having a Nb- and Ta-content according to the invention. A carbon content of 100 ppm increases the losses after an annealing treatment of 871° C. for 2 hours. The carbon content should be kept low to achieve low losses.

Figure 9:
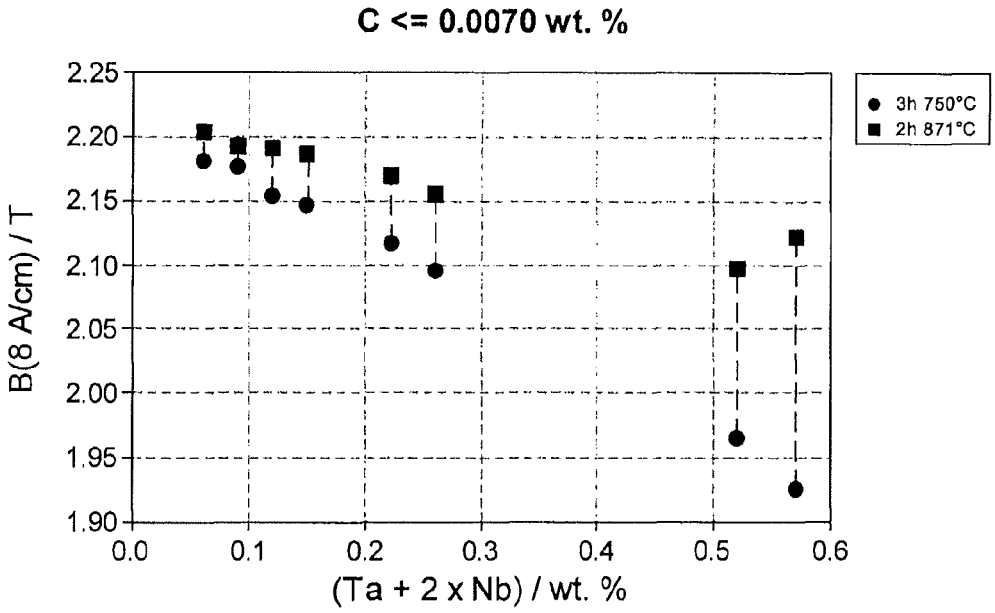
FIG. 9 illustrates a graph of magnetic induction B (8 A/cm) vs. (Ta+2×Nb) for a low carbon content.

FIG. 9 illustrates a graph of magnetic induction B (8 A/cm) vs. (Ta+2×Nb) for a low carbon content of maximum 0.007 wt. %. The magnetic induction B (8 A/cm) decreases with increasing Nb and Ta content. However, for the alloys having a Ta and Nb (y+2x) of less than around 0.3 wt. %, the decrease is moderate after an annealing treatment at 871° C. for 2 hours.

Figure 10:
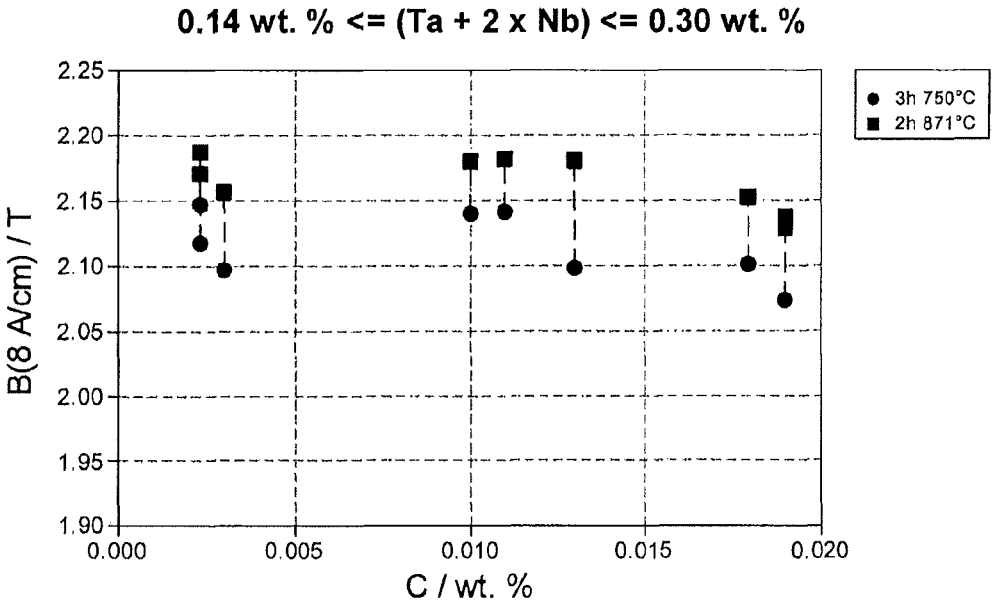
FIG. 10 illustrates a graph of magnetic induction B (8 A/cm) vs. carbon content for alloys having a Nb- and Ta-content according to the invention.

FIG. 10 illustrates a graph of magnetic induction B (8 A/cm) vs. carbon content for alloys having a Nb- and Ta-content according to embodiments described herein. A higher carbon content leads to a lower magnetic induction.

Figure 11:
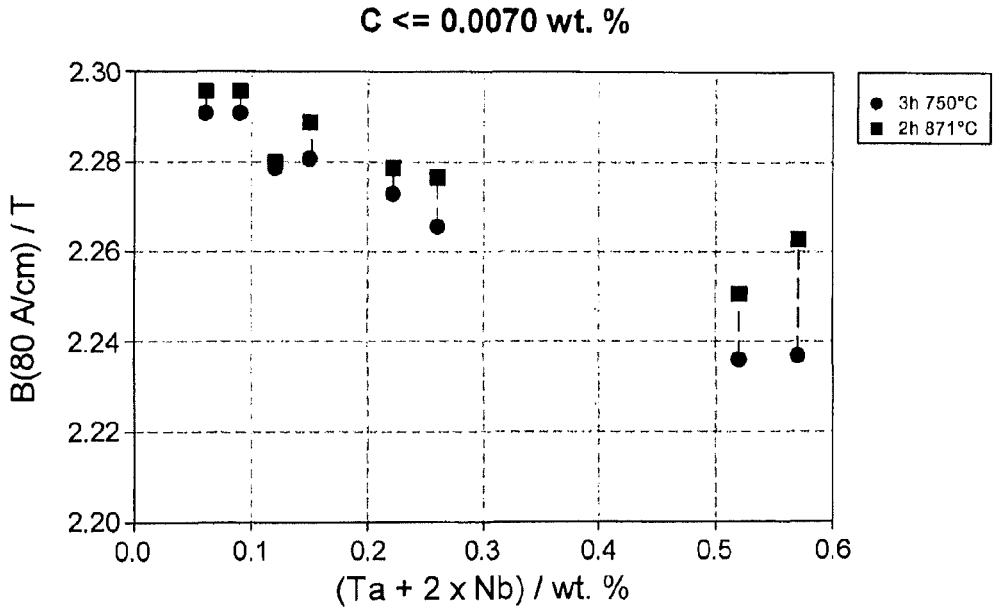
FIG. 11 illustrates a graph of magnetic induction B (80 A/cm) vs. (Ta+2×Nb) for low carbon contents.

FIG. 11 illustrates a graph of magnetic induction B (80 A/cm) vs. (Ta+2×Nb) for sample alloys with a carbon content of less than or equal to 0.007 weight percent. The magnetic induction B (80 A/cm) decreases with increasing Nb and Ta content. However, for the alloys having a Ta and Nb content (y+2x) of less than around 0.3, the decrease is moderate after an annealing treatment at 871° C. for 2 hours.

Figure 12:
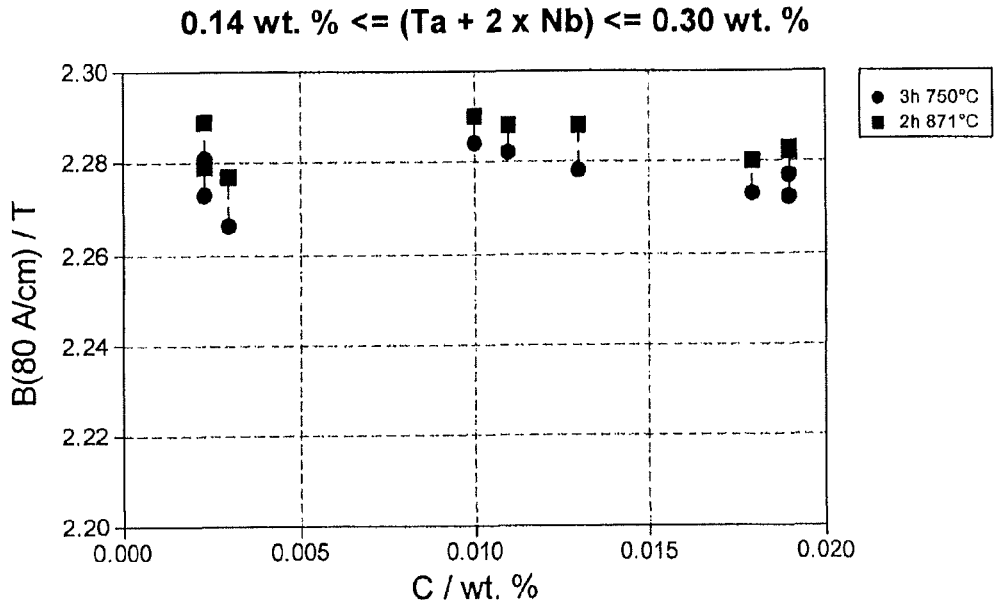
FIG. 12 illustrates a graph of magnetic induction B (80 A/cm) vs. carbon content for Nb- and Ta-contents according to the invention.

FIG. 12 illustrates a graph of magnetic induction B (80 A/cm) vs. carbon content for Nb- and Ta-contents according to the invention. No significant effect is observed.

Figure 13:
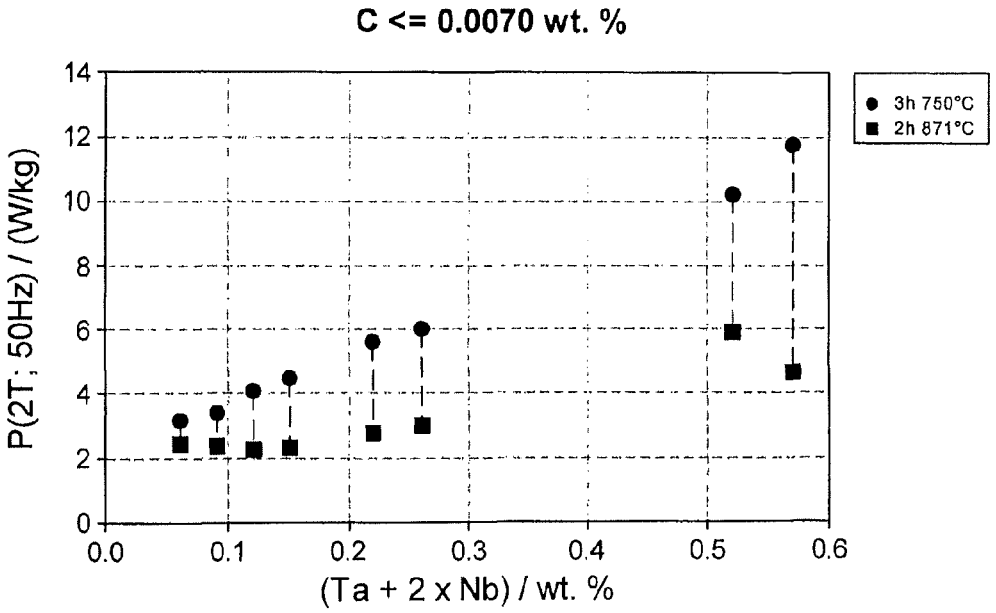
FIG. 13 illustrates a graph of power loss density P (2 T; 50 Hz) vs. (Ta+2×Nb) for a low carbon contents.

FIG. 13 illustrates a graph of power loss density P (2 T; 50 Hz) vs. (Ta+2×Nb) for a carbon contents of less than or equal to 0.007 weight percent. A strong increase in losses is observed for (y+2x) greater than 0.3 wt. %.

Figure 14:
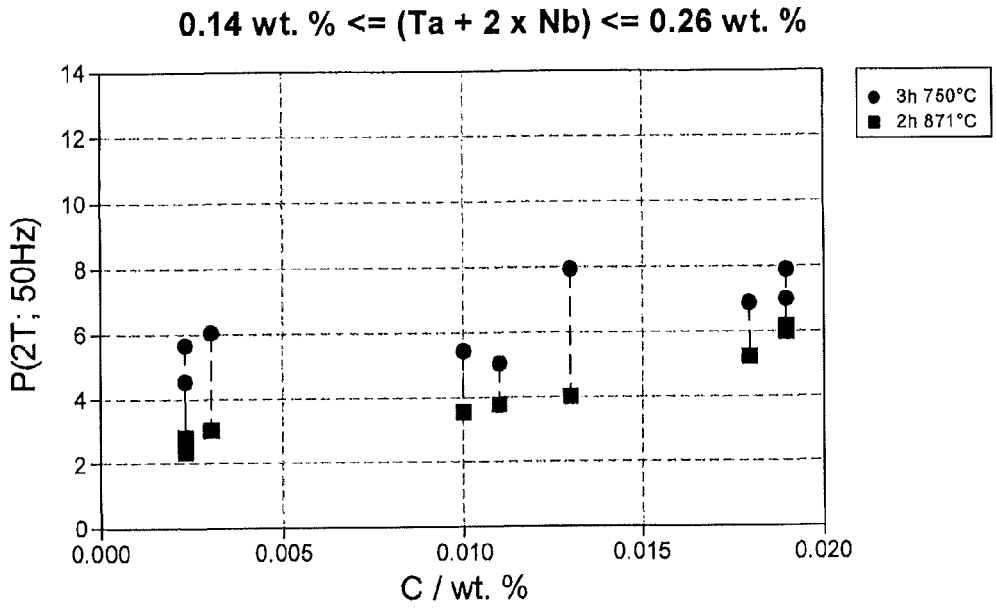
FIG. 14 illustrates a graph of power loss density P (2 T; 50 Hz) vs. carbon content for Nb- and Ta-contents according to the invention.

FIG. 14 illustrates a graph of power loss density P (2 T; 50 Hz) vs. carbon content for Nb- and Ta-contents (y+2x) according to embodiments described herein. It is observed that alloys with increasing carbon contents have increased losses.

Figure 15:
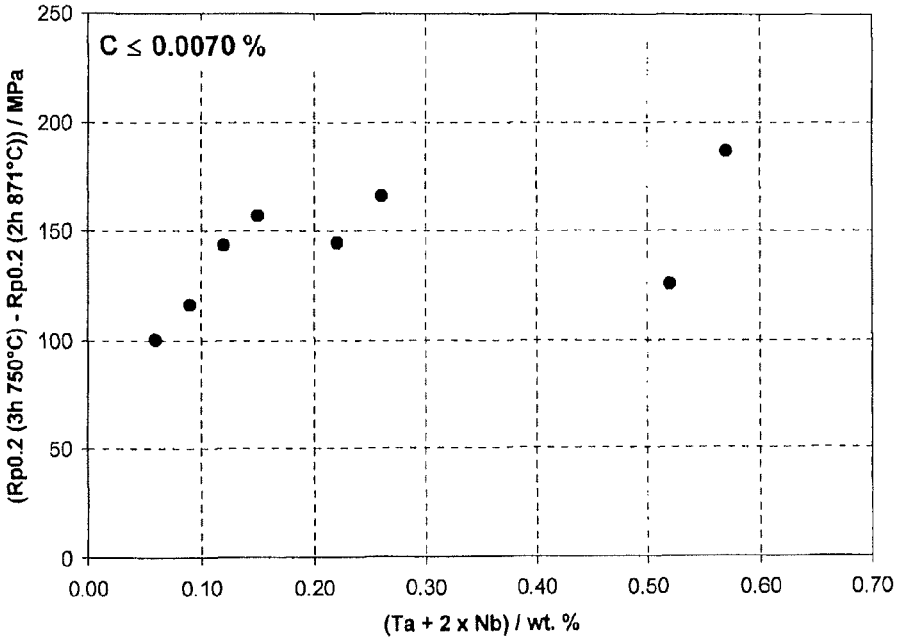
FIG. 15 illustrates a graph of the range of the yield strength vs. Ta and Nb content for C≤0.0070%.

FIG. 15 illustrates a graph of the range of the yield strength for an alloy annealed at 750° C. for 3 hours and at 871° C. for 2 hours vs. the Ta and Nb content (y+2x) for C≤0.0070%: The yield strength remains largely unaffected with increasing Ta and Nb.

Figure 16:
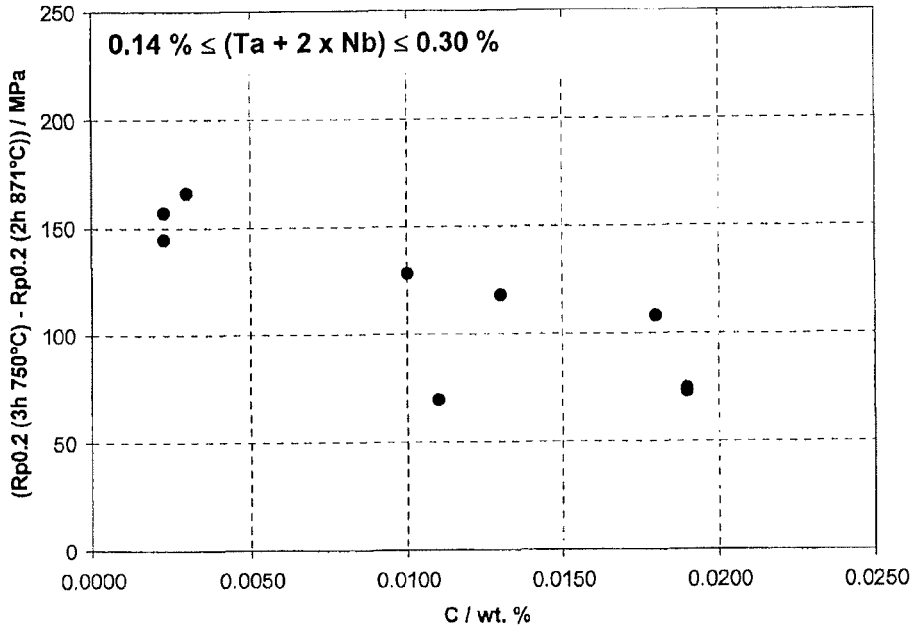
FIG. 16 illustrates a graph of the range of the yield strength vs. carbon content for 0.14 wt. %<=Ta+2×Nb<=0.30 wt. %.

FIG. 16 illustrates a graph of the range of the yield strength obtained for an alloy annealed at 750° C. for 3 hours and at 871° C. for 2 hours vs. carbon content for 0.14 wt. %≤Ta+2×Nb≤0.30 wt. % The range over which the yield strength can be adjusted with a temperature difference of 121° C. decreases with increasing carbon content. The largest range of yield strength values is achievable with a carbon content of less than 0.005 weight percent.

In a second set of embodiments, illustrated in FIGS. 17 to 21, magnetic properties are illustrated as a function of yield strength, $Rp_{0.2}$.

In FIGS. 17 to 21, "A" denotes alloys according to embodiments described herein, i.e., 0.14 wt. %≤(Ta+2×Nb)≤0.30 wt. %, C≤0.0070% and "B" denotes a comparison composition of a reference alloy with (Ta+2×Nb)≤0.12 wt. %, 0.0080 wt. %≤C≤0.0120 wt. %. These reference alloys have compositions similar to those disclosed in U.S. Pat. No. 3,634,072 and similar to the commercially available alloy Hiperco 50.

FIGS. 17 to 21 illustrate that the highest and lowest values of $Rp_{0.2}$ are achieved with alloy "A" indicating that the yield strength is adjustable over a wider range than is achievable with the comparison alloy B.

Figure 17:
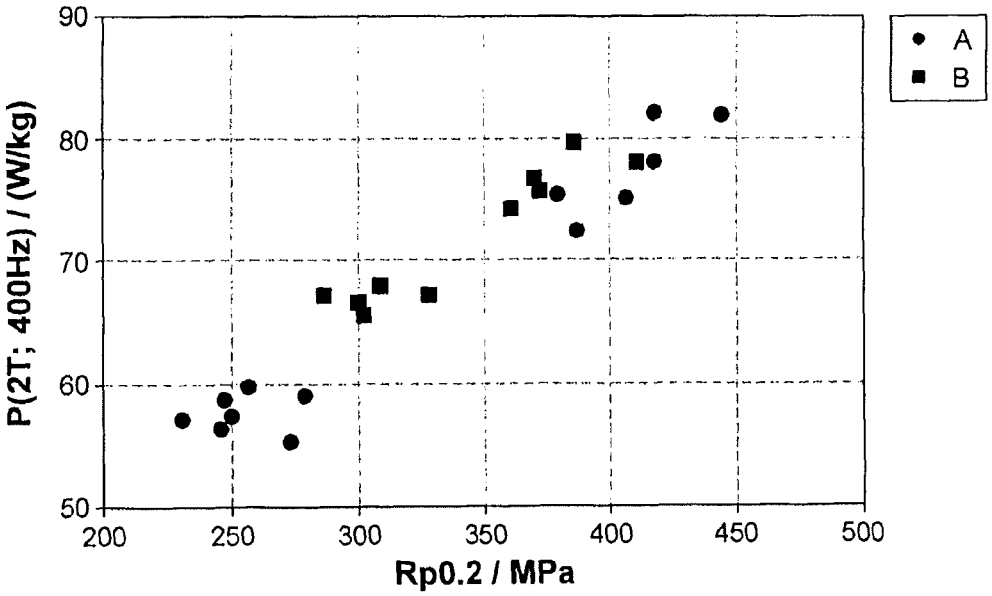
FIG. 17 illustrates a graph of power loss density P (2 T; 400 Hz) vs. yield strength $Rp_{0.2}$.

FIG. 17 illustrates a graph of power loss density P (2 T; 400 Hz) vs. yield strength $Rp_{0.2}$. The losses increase with increasing $Rp_{0.2}$ with clearly lower losses for alloys "A".

A soft magnetic alloy with low power loss density is provided by the soft magnetic alloy according to the embodiments described herein. The alloy can be used as a stator of an electric machine due to the low losses and good magnetic properties.

Figure 18:
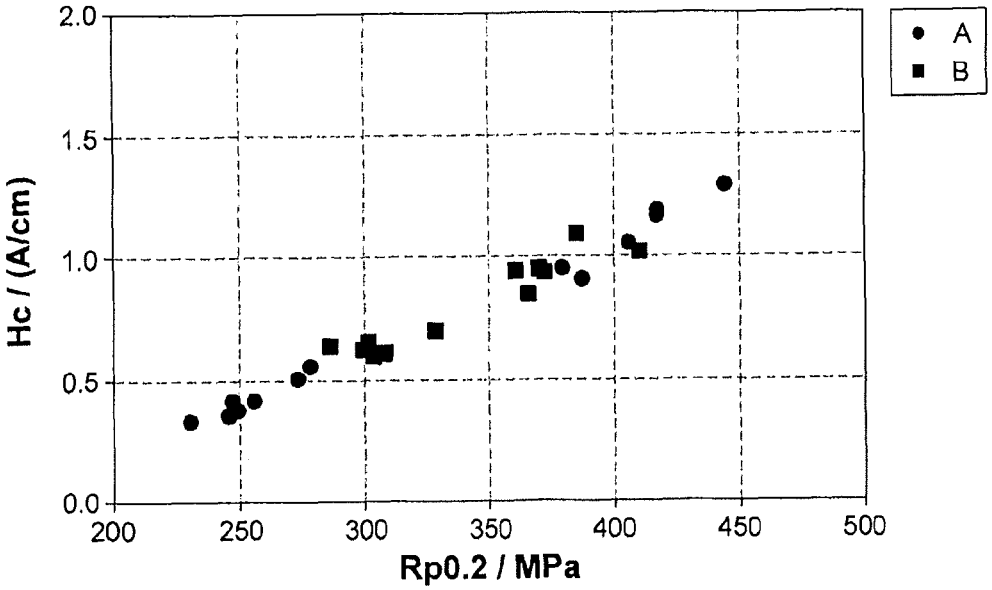
FIG. 18 illustrates a graph of coercive field strength Hc vs. yield strength $Rp_{0.2}$.
Figure 19:
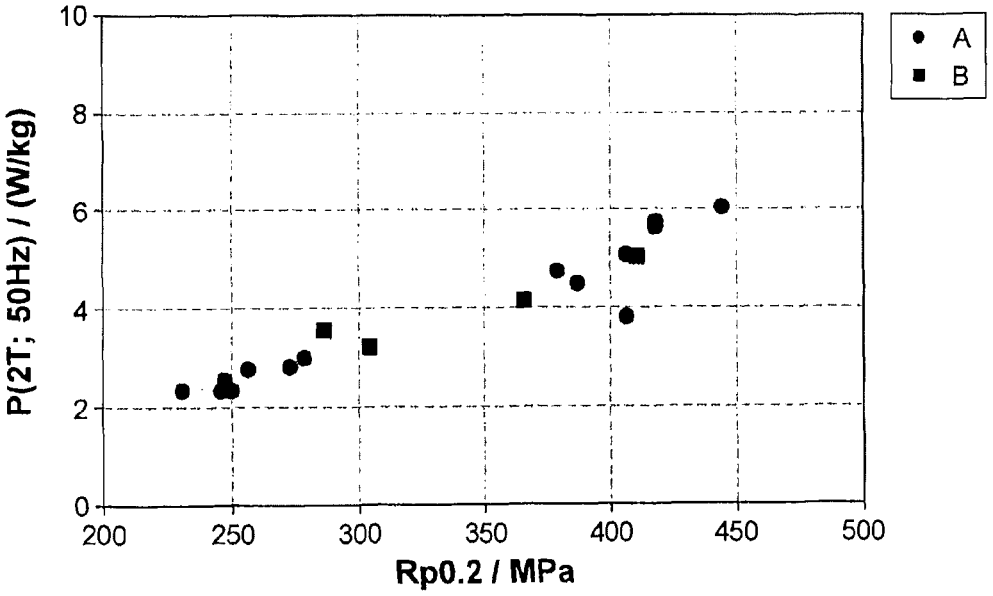
FIG. 19 illustrates a graph of power loss density P (2 T; 50 Hz) vs. yield strength $Rp_{0.2}$.
Figure 20:
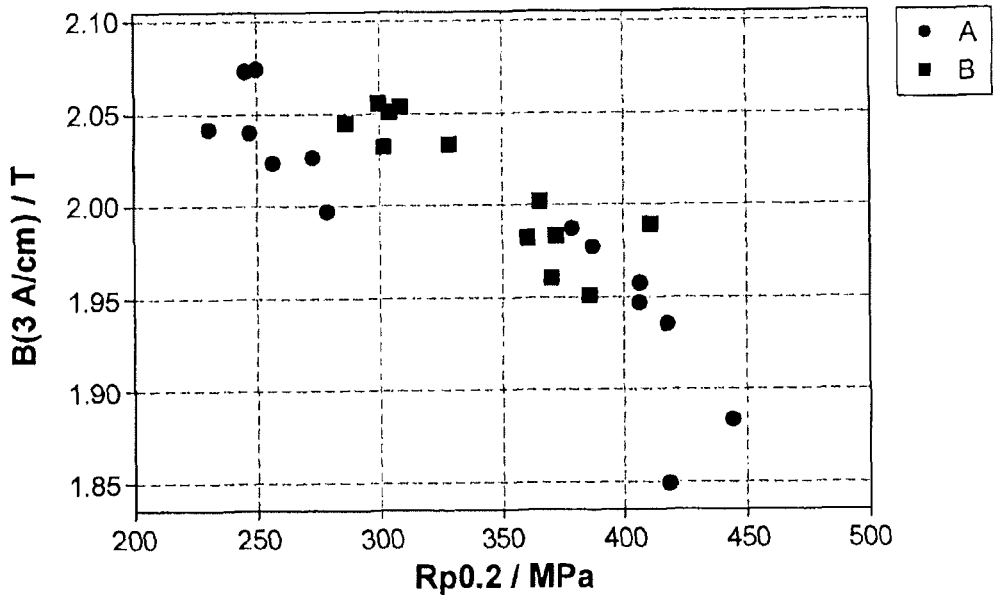
FIG. 20 illustrates a graph of magnetic induction B (3 A/cm) vs. yield strength $Rp_{0.2}$.
Figure 21:
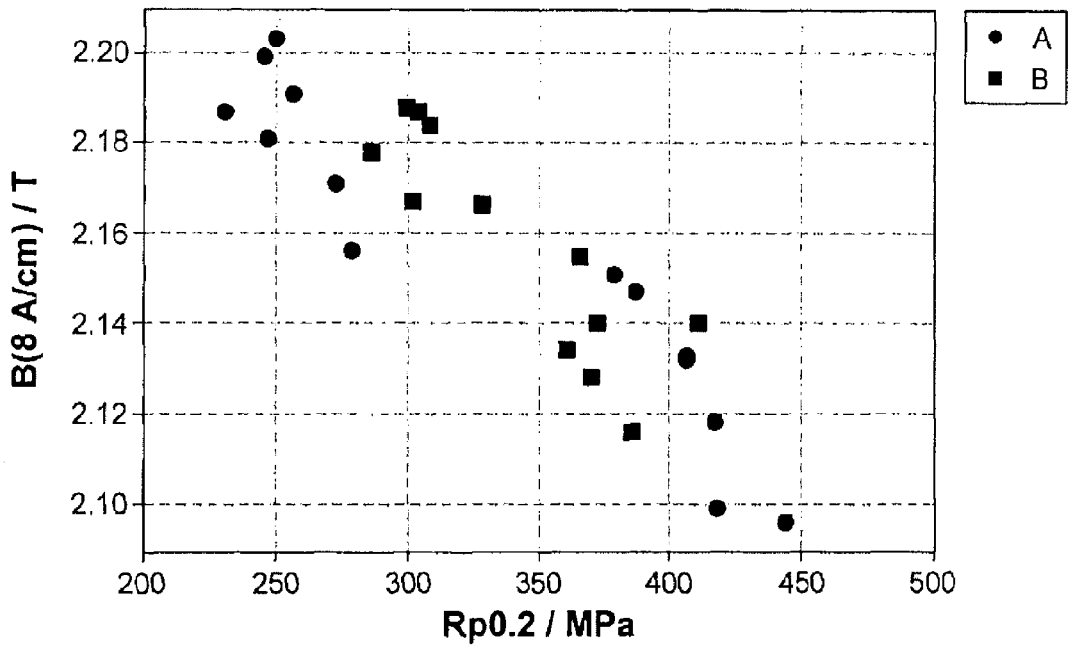
FIG. 21 illustrates a graph of magnetic induction B (8 A/cm) vs. yield strength $Rp_{0.2}$.

FIG. 18 illustrates a graph of coercive field strength Hc vs. yield strength $Rp_{0.2}$, FIG. 19 illustrates a graph of power loss density P (2 T; 50 Hz) vs. yield strength $Rp_{0.2}$, FIG. 20 illustrates a graph of magnetic induction B (3 A/cm) vs. yield strength $Rp_{0.2}$ and FIG. 21 illustrates a graph of magnetic induction B (8 A/cm) vs. yield strength $Rp_{0.2}$. Generally, the magnetic properties are observed to worsen with increasing $Rp_{0.2}$.

FIGS. 17 to 21 illustrate that due to the small carbon content of ≤0.007 weight percent and Nb and Ta content such that 0.14 weight percent≤(y+2x)≤0.3 weight percent of the alloy according to the embodiments described herein, denoted "A", an extended range of values of the yield strength of around 200 MPa to around 450 MPa can be provided for a single composition compared to the composition B which has a lower value of (Ta+2×Nb)≤0.12 wt. % and a higher carbon content of 0.0080 wt. %≤C≤0.0120 wt. %.

TABLE 1

| Batch | Co % | V % | Ni % | Nb % | Ta % | C % | Ta + 2 × Nb % | anneal | Hc A/cm | B3 T | B8 T | B80 T | P2;50 W/kg | P2;400 W/kq | E GPa | Rp02 MPa | Rm MPa | A % | HV10 | ΔRp02 MPa |
|---|---|---|---|---|---|---|---|---|---|---|---|---|---|---|---|---|---|---|---|---|
| 9308852 | 48.70 | 1.91 | — | | 0.06 | 0.0022 | 0.06 | 3 h 750° C. | 0.55 | 2.027 | 2.182 | 2.291 | 3.16 | 63.0 | 207 | 321 | 668 | 8.0 | 192 | 100 |
| | | | | | | | | 2 h 871° C. | 0.34 | 2.050 | 2.205 | 2.296 | 2.47 | 56.6 | 222 | 221 | 446 | 5.4 | 190 | |
| 9308853 | 48.75 | 1.91 | — | | 0.07 | 0.0100 | 0.07 | 3 h 750° C. | 0.84 | 2.002 | 2.155 | 2.284 | 4.15 | (*) | 227 | 366 | 736 | 8.5 | 214 | 62 |
| | | | | | | | | 2 h 871° C. | 0.60 | 2.051 | 2.187 | 2.291 | 3.22 | (*) | 219 | 304 | 628 | 7 | 205 | |
| 9308854 | 48.60 | 1.92 | 0.01 | | 0.08 | 0.0150 | 0.08 | 3 h 750° C. | 1.24 | 1.957 | 2.125 | 2.282 | 5.98 | 87.7 | 229 | 413 | 816 | 9.1 | 229 | 83 |
| | | | | | | | | 2 h 871° C. | 0.84 | 2.033 | 2.172 | 2.290 | 4.43 | 76.0 | 219 | 330 | 712 | 8.1 | 216 | |
| 9308855 | 48.70 | 1.91 | — | | 0.09 | 0.0021 | 0.09 | 3 h 750° C. | 0.63 | 2.027 | 2.177 | 2.291 | 3.39 | 64.1 | 220 | 343 | 591 | 6.2 | 199 | 116 |
| | | | | | | | | 2 h 871° C. | 0.33 | 2.033 | 2.193 | 2.296 | 2.39 | 58.8 | 211 | 226 | 439 | 5.1 | 187 | |
| 9308285B | 49.25 | 1.83 | 0.06 | 0.06 | | 0.0110 | 0.12 | 3 h 750° C. | 0.94 | 1.982 | 2.134 | 2.290 | — | 74.3 | 217 | 361 | 822 | 10.3 | — | 59 |
| | | | | | | | | 2 h 871° C. | 0.65 | 2.032 | 2.167 | 2.292 | — | 65.6 | 211 | 301 | 687 | 8.5 | — | |
| 9308286B | 48.55 | 1.83 | 0.05 | 0.06 | | 0.0110 | 0.12 | 3 h 750° C. | 0.94 | 1.983 | 2.140 | 2.285 | — | 75.7 | 216 | 372 | 786 | 9.2 | — | 64 |
| | | | | | | | | 2 h 871° C. | 0.61 | 2.054 | 2.184 | 2.289 | — | 68.0 | 221 | 308 | 673 | 8.1 | — | |
| 9308287B | 48.55 | 1.84 | 0.06 | 0.06 | | 0.0100 | 0.12 | 3 h 750° C. | 0.95 | 1.961 | 2.128 | 2.285 | — | 76.7 | 220 | 370 | 778 | 9.1 | — | 71 |
| | | | | | | | | 2 h 871° C. | 0.62 | 2.056 | 2.188 | 2.289 | — | 66.6 | 217 | 299 | 674 | 8.1 | — | |
| 9308288B | 49.35 | 1.82 | 0.04 | 0.06 | | 0.0120 | 0.12 | 3 h 750° C. | 1.09 | 1.951 | 2.116 | 2.281 | — | 79.8 | 223 | 385 | 729 | 7.9 | — | 43 |
| | | | | | | | | 2 h 871° C. | 0.70 | 2.033 | 2.166 | 2.284 | — | 67.2 | 213 | 328 | 648 | 7.2 | — | |
| 9308604 | 48.85 | 1.87 | 0.04 | 0.06 | | 0.0038 | 0.12 | 3 h 750° C. | 0.81 | 2.008 | 2.155 | 2.279 | 4.11 | 69.2 | 230 | 384 | 839 | 10.5 | 224 | 144 |
| | | | | | | | | 2 h 871° C. | 0.37 | 2.068 | 2.192 | 2.280 | 2.27 | 55.4 | 187 | 240 | 486 | 5.9 | 179 | |
| 9308605 | 48.85 | 1.89 | 0.04 | 0.06 | | 0.0100 | 0.12 | 3 h 750° C. | 1.02 | 1.989 | 2.140 | 2.280 | 5.07 | 78.1 | 245 | 410 | 809 | 9.0 | 233 | 124 |
| | | | | | | | | 2 h 871° C. | 0.64 | 2.045 | 2.178 | 2.281 | 3.57 | 67.3 | 179 | 286 | 623 | 7.0 | 200 | |
| 9308856 | 48.65 | 1.92 | 0.01 | | 0.15 | 0.0023 | 0.15 | 3 h 750° C. | 0.91 | 1.977 | 2.147 | 2.281 | 4.51 | 72.4 | 229 | 387 | 860 | 10.8 | 210 | 157 |
| | | | | | | | | 2 h 871° C. | 0.34 | 2.042 | 2.187 | 2.289 | 2.35 | 57.2 | 226 | 230 | 581 | 7.8 | 185 | |
| 9308857 | 48.50 | 1.93 | 0.01 | | 0.16 | 0.0110 | 0.16 | 3 h 750° C. | 0.99 | 1.984 | 2.141 | 2.282 | 5.04 | 74.9 | 213 | 403 | 887 | 10.7 | 213 | 70 |
| | | | | | | | | 2 h 871° C. | 0.69 | 2.050 | 2.182 | 2.288 | 3.75 | 65.6 | 224 | 334 | 734 | 8.4 | 210 | |
| 9308858 | 48.60 | 1.93 | — | | 0.17 | 0.0190 | 0.17 | 3 h 750° C. | 1.68 | 1.840 | 2.073 | 2.272 | 7.86 | 100.5 | 219 | 462 | 975 | 11.5 | 236 | 73 |
| | | | | | | | | 2 h 871° C. | 1.21 | 1.986 | 2.137 | 2.283 | 5.95 | 86.9 | 227 | 389 | 856 | 9.9 | 226 | |
| 9308601 | 48.65 | 1.89 | 0.04 | 0.09 | | 0.0180 | 0.18 | 3 h 750° C. | 1.41 | 1.918 | 2.101 | 2.273 | 6.87 | 96.1 | 215 | 441 | 857 | 9.4 | 233 | 108 |
| | | | | | | | | 2 h 871° C. | 1.02 | 2.005 | 2.152 | 2.280 | 5.16 | 82.0 | 197 | 333 | 613 | 5.8 | 224 | |
| 9308489 | 48.55 | 1.84 | 0.01 | 0.10 | | 0.0100 | 0.20 | 3 h 750° C. | 1.10 | 1.982 | 2.140 | 2.284 | 5.41 | 83.5 | 267 | 433 | 729 | 7.0 | — | 128 |
| | | | | | | | | 2 h 871° C. | 0.59 | 2.039 | 2.180 | 2.290 | 3.51 | 68.9 | 225 | 304 | 644 | 7.2 | — | |
| 9308490 | 48.50 | 1.84 | 0.01 | 0.10 | | 0.0130 | 0.20 | 3 h 750° C. | 1.47 | 1.914 | 2.098 | 2.278 | 7.91 | 102.5 | 238 | 445 | 804 | 8.4 | — | 118 |
| | | | | | | | | 2 h 871° C. | 0.68 | 2.046 | 2.180 | 2.288 | 3.99 | 70.0 | 213 | 327 | 685 | 7.4 | — | |
| 9308491 | 48.55 | 1.84 | 0.01 | 0.10 | | 0.0190 | 0.20 | 3 h 750° C. | 1.69 | 1.847 | 2.073 | 2.277 | 6.96 | 94.4 | 249 | 475 | 920 | 10.1 | — | 75 |
| | | | | | | | | 2 h 871° C. | 1.25 | 1.967 | 2.129 | 2.282 | 6.11 | 88.4 | 225 | 401 | 887 | 10.6 | — | |
| 9308603 | 48.70 | 1.87 | 0.04 | 0.11 | | 0.0023 | 0.22 | 3 h 750° C. | 1.19 | 1.935 | 2.118 | 2.273 | 5.65 | 78.2 | 216 | 417 | 810 | 9.2 | 232 | 145 |
| | | | | | | | | 2 h 871° C. | 0.50 | 2.026 | 2.171 | 2.279 | 2.81 | 55.4 | 181 | 273 | 592 | 7.3 | 186 | |
| 9308599 | 48.65 | 1.87 | 0.05 | 0.13 | | 0.0030 | 0.26 | 3 h 750° C. | 1.30 | 1.883 | 2.096 | 2.266 | 6.05 | 82.0 | 226 | 444 | 825 | 8.9 | 227 | 166 |
| | | | | | | | | 2 h 871° C. | 0.56 | 1.997 | 2.156 | 2.277 | 3.00 | 59.1 | 199 | 278 | 588 | 7.1 | 194 | |
| 9308606 | 48.70 | 1.79 | 0.04 | 0.26 | | 0.0031 | 0.52 | 3 h 750° C. | 2.00 | 1.469 | 1.965 | 2.236 | 10.24 | 113.8 | 210 | 491 | 939 | 9.9 | 260 | 126 |
| | | | | | | | | 2 h 871° C. | 1.27 | 1.902 | 2.098 | 2.251 | 5.91 | 80.4 | 207 | 365 | 721 | 7.6 | 221 | |
| 9308860 | 48.50 | 1.93 | — | | 0.57 | 0.0025 | 0.57 | 3 h 750° C. | 2.27 | 1.331 | 1.925 | 2.237 | 11.76 | 129.6 | 236 | 525 | 1116 | 13.5 | 271 | 187 |
| | | | | | | | | 2 h 871° C. | 0.99 | 1.931 | 2.123 | 2.263 | 4.66 | 72.7 | 219 | 338 | 741 | 8.7 | 211 | |
| 9308607 | 48.90 | 1.87 | 0.04 | 0.32 | | 0.0100 | 0.64 | 3 h 750° C. | 1.75 | 1.656 | 2.021 | 2.248 | 8.62 | 107.0 | 209 | 473 | 935 | 10.2 | 252 | 107 |
| | | | | | | | | 2 h 871° C. | 1.39 | 1.871 | 2.088 | 2.254 | 6.31 | 85.4 | 244 | 366 | 731 | 7.7 | 216 | |

Composition in weight percent

B3 = B(3 A/cm); B8 = B(8 A/cm); B80 = B(80 A/cm), with air flow correction

P2;50 = P(2.0 T; 50 Hz); P2;400 = P(2.0 T; 400 Hz); tape thickness 0.35 mm

TABLE 1-continued

| Batch | Co % | V % | Ni % | Nb % | Ta % | C % | Ta + 2 × Nb % | anneal | Hc A/cm | B3 T | B8 T | B80 T | P2;50 W/kg | P2;400 W/kq | E GPa | Rp02 MPa | Rm MPa | A % | HV10 | ΔRp02 MPa |
|---|---|---|---|---|---|---|---|---|---|---|---|---|---|---|---|---|---|---|---|---|

E = E-Modulus;
Rp02 = yield strength;
Rm = ultimate tensile strength;
A = elongation to fraction;
HV10 = Vickers hardness ΔRp0.2 = Rp0.2 (3 h 750° C.) - Rp0.2 (2 h 871° C.)
(*) Charge 9308853: losses at 400 Hz not measured

The invention claimed is:

1. A soft magnetic alloy consisting essentially of 47 weight percent≤Co≤50 weight percent, 1 weight percent≤V≤3 weight percent, 0 weight percent<Ni≤0.25 weight percent, 0 weight percent≤C≤0.007 weight percent, 0 weight percent≤Mn≤0.1 weight percent, 0 weight percent≤Si≤0.1 weight percent, niobium in an amount of x weight percent of niobium, remainder Fe, wherein Zr is present in an amount of not more than 0.5 weight percent, wherein 0.07 weight percent≤x<0.125 weight percent, wherein the alloy has been annealed at a temperature in the range of 730° C. to 880° C. for a time of 1 to 6 hours, wherein the soft magnetic alloy has a yield strength (0.2% strain) in the range of 200 MPa to 450 MPa and has a coercive field strength of 0.3 A/cm to 1.5 A/cm, and wherein the soft magnetic alloy has a resistivity of at least 0.4 μΩm or an induction B (8 A/m) of at least 2.12 T, or both.

2. The soft magnetic alloy according to claim 1, wherein 0 weight percent≤Ni≤0.20 weight percent.

3. The soft magnetic alloy according to claim 1, wherein 0 weight percent≤C≤0.005 weight percent.

4. The soft magnetic alloy according to claim 3, wherein 0 weight percent≤C<0.003 weight percent.

5. The soft magnetic alloy according to claim 1, wherein the alloy has a nickel content such that 0 weight percent<Ni≤0.2 weight percent.

6. The soft magnetic alloy according to claim 1, wherein the alloy has a manganese content such that 0 weight percent<Mn≤0.07 weight percent.

7. The soft magnetic alloy according to claim 1, wherein the alloy has a silicon content such that 0 weight percent<Si≤0.05 weight percent.

8. The soft magnetic alloy according to claim 1, wherein the soft magnetic alloy has a resistivity of at least 0.4 μΩm.

9. The soft magnetic alloy according to claim 1, wherein the soft magnetic alloy has an induction B (8 A/m) of at least 2.12 T.

10. The soft magnetic alloy according to claim 1, wherein the soft magnetic alloy has a composition which is selected so that the yield strength of the soft magnetic alloy is adjustable over a range of at least 130 MPa after having been annealed at 750° C. or at 871° C.

11. The soft magnetic alloy according to claim 1, wherein in an annealed state, the soft magnetic alloy has a yield strength (0.2% strain) that lies within ±10% of a linear function of yield strength (0.2% strain) against annealing temperature.

12. The soft magnetic alloy according to claim 1, wherein the soft magnetic alloy has a yield strength (0.2% strain) that is a linear function of annealing temperature over an annealing temperature range of 730° C. to 900° C.

13. The soft magnetic alloy according to claim 12, wherein the soft magnetic alloy has a yield strength (0.2% strain) that is a linear function of annealing temperature over an annealing temperature range of 740° C. to 865° C.

14. A stator for an electric motor comprising the soft magnetic alloy according to claim 1.

15. A rotor for an electric motor comprising the soft magnetic alloy according to claim 1.

16. An electric motor comprising a stator and rotor, each comprising a soft magnetic alloy according to claim 1.

17. A method for manufacturing a rotor for an electric motor comprising providing the soft magnetic alloy according to claim 1 and annealing at a temperature of 730 to 790° C.

18. A method for manufacturing a stator for an electric motor comprising providing the soft magnetic alloy according to claim 1 and annealing at a temperature of 800° C. to 880° C.

19. A method for manufacturing a soft magnetic alloy, comprising:

providing a melt consisting essentially of 47 weight percent≤Co≤50 weight percent, 1 weight percent≤V≤3 weight percent, 0 weight percent≤Ni≤0.25 weight percent, 0 weight percent≤C≤0.007 weight percent, 0 weight percent≤Mn≤0.1 weight percent, 0 weight percent≤Si≤0.1 weight percent, niobium in an amount of x weight percent, remainder Fe, wherein Zr is present in an amount of not more than 0.5 weight percent, wherein 0.07 weight percent≤x≤0.125 weight percent;

cooling and solidifying the melt and forming a blank;

hot rolling the blank, followed by quenching the blank from a temperature above 730° C., followed by cold rolling the blank, and subsequently annealing at least a portion of the blank at a temperature in the range of 730° C. to 880° C. and producing a yield strength in the range of 200 MPa to 450 MPa and a coercive field strength of 0.3 A/cm to 1.5 A/cm, and wherein the soft magnetic alloy has a resistivity of at least 0.4 μΩm or an induction B (8 A/m) of at least 2.12 T, or both.

20. The method according to claim 19, wherein at least a portion of the blank is annealed at a temperature in the range of 740° C. to 865° C.

21. The method according to claim 19, wherein at least a portion of the blank is annealed at a temperature in the range of 730° C. to 790° C. or in the range of 800° C. to 880° C.

22. The method according to claim 19, wherein the hot rolling of the blank produces a thickness reduction in the blank of 90%.

23. The method according to claim 19, wherein the hot rolling of the blank includes rolling at a temperature in the range of 1100° C. to 1300° C.

24. The method according to claim 19, further comprising after hot rolling, cooling the blank and quenching from a temperature of above 730° C. to room temperature or cooling the blank and reheating to a temperature above 730° C. and then quenching to room temperature.

25. The method according to claim 19, further comprising pickling the blank before cold rolling.

26. The method according to claim 19, wherein the cold rolling of the blank produces a thickness reduction in the blank of 90%.

27. The method according to claim 19, wherein after cold rolling, the thickness of the blank lies in the range of 0.3 mm to 0.4 mm.

28. A method for manufacturing a semi-finished part comprising forming a blank according to the method according to claim 19, and separating a portion of the blank to produce a semifinished part.

29. The method according to claim 28, further comprising assembling a plurality of semi-finished parts manufactured by the method according to claim 28 and forming a laminated soft magnetic article.

* * * * *